US012060715B2

(12) United States Patent
Dhale et al.

(10) Patent No.: US 12,060,715 B2
(45) Date of Patent: Aug. 13, 2024

(54) SUPPORT BLOCK ASSEMBLY

(71) Applicant: Eaton Intelligent Power Limited, Dublin (IE)

(72) Inventors: Sayali Shridhar Dhale, Yavatmal (IN); Nicholas Robert Grahek, Glen Carbon, IL (US); Brandon Michael Tally, Greenville, IL (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/852,838

(22) Filed: Jun. 29, 2022

(65) Prior Publication Data

US 2023/0003027 A1 Jan. 5, 2023

Related U.S. Application Data

(60) Provisional application No. 63/217,946, filed on Jul. 2, 2021.

(51) Int. Cl.
*E04D 13/00* (2006.01)
*E04H 12/12* (2006.01)

(52) U.S. Cl.
CPC ..... *E04D 13/00* (2013.01); *E04H 12/12* (2013.01)

(58) Field of Classification Search
CPC ..... E04D 13/00; E04D 13/12; E04H 12/12; F24F 13/0272
USPC ..... 52/745.21, 746.11, 299, 408, 698, 173.3, 52/24, 27, 219, 248, 237
See application file for complete search history.

(56) References Cited

U.S. PATENT DOCUMENTS 2,527,063 A * 10/1950 Heuer ..... B28B 23/005 264/274
3,740,918 A * 6/1973 Meyer ..... B29C 66/1122 52/312
4,354,655 A * 10/1982 Hengst ..... F16M 7/00 248/676
6,679,461 B1 * 1/2004 Hawkins ..... F16L 3/243 248/68.1
9,683,590 B2 * 6/2017 Zhang ..... F16B 7/0473
2009/0313912 A1 * 12/2009 Perry ..... E04H 12/12 52/40

* cited by examiner

*Primary Examiner* — Kimberly T Wood
(74) *Attorney, Agent, or Firm* — Stinson LLP

(57) ABSTRACT

The present disclosure is directed to a support block assembly including a strut and an overmolded support block. The strut may include a base, and the support block may include an anchor coupled to the strut. The anchor includes a tang with the support block overmolded on the tang with the tang extending into and encased within the support block forming a bond between the tang and the support block. In an embodiment, the base may define at least one opening. The support block is overmolded on the strut such that the support block extends through at least one opening to form the bond between the strut and the support block. The strut may include a lower side defining a dovetail-shaped groove with the support block overmolded on the strut and extending into the dovetail-shaped groove to form a bond between the strut and the support block.

7 Claims, 14 Drawing Sheets

SUPPORT BLOCK ASSEMBLY

CROSS-REFERENCE TO RELATED APPLICATION

This application claims priority to U.S. Provisional Patent Application Ser. No. 63/217,946, filed Jul. 2, 2021, which is hereby incorporated by reference in its entirety.

FIELD OF THE DISCLOSURE

The present disclosure is directed to a support assembly having a support block and a strut anchored to the support block.

BACKGROUND

Typically, service units are placed on rooftops, especially on commercial buildings, and include pipes or ductwork along the roof, as well as roof walkway systems to allow access to the service units. These units and systems must be provided adequate support to prevent damage to the roof.

Existing support block assemblies typically require a rooftop block assembled with a strut on location using a pair of fasteners, which can be both time consuming and expensive. There may be other uses for support block assemblies, other than rooftop applications.

SUMMARY

In one aspect, a support block assembly comprises a strut, an anchor, and a support block. The strut includes a base. The anchor is coupled to the strut and includes a tang extending downward from the base of the strut. The support block is overmolded on the tang of the anchor such that the tang extends into the support block and is encased within the support block to form a mechanical and/or chemical bond between the tang and the support block to secure the strut to the support block.

In another aspect, a support block assembly comprises a strut and a support block. The strut includes a lower side that defines a dovetail-shaped groove. The support block is overmolded on the strut such that the support block extends into the dovetail-shaped groove of the lower side of the strut to form a mechanical and/or chemical bond between the strut and the support block.

In yet another aspect, a support block assembly comprises a strut, and a support block. The strut includes a base that defines at least one opening. The support block is overmolded on the strut such that the support block extends through the at least one opening of the strut to form a mechanical and/or chemical bond between the strut and the support block to secure the strut to the block.

Other objects and features will be in part apparent and in part pointed out hereinafter.

BRIEF DESCRIPTION OF THE SEVERAL VIEWS OF THE DRAWING

Corresponding reference characters indicate corresponding parts throughout the drawings.

DETAILED DESCRIPTION

Figure 1:
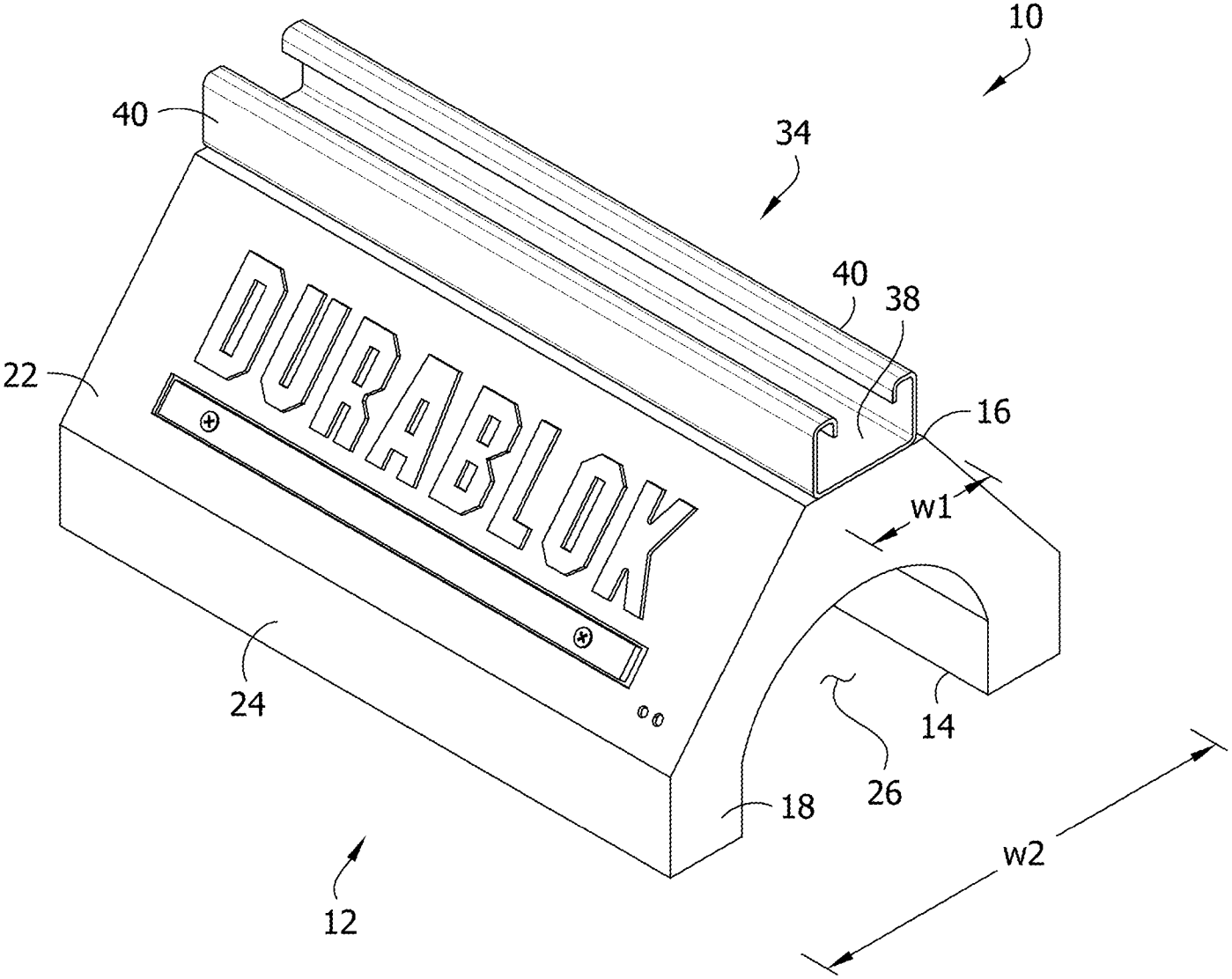
FIG. 1 is a perspective view of one embodiment of a support block assembly, having a support block, a strut, and anchors.
Figure 2:
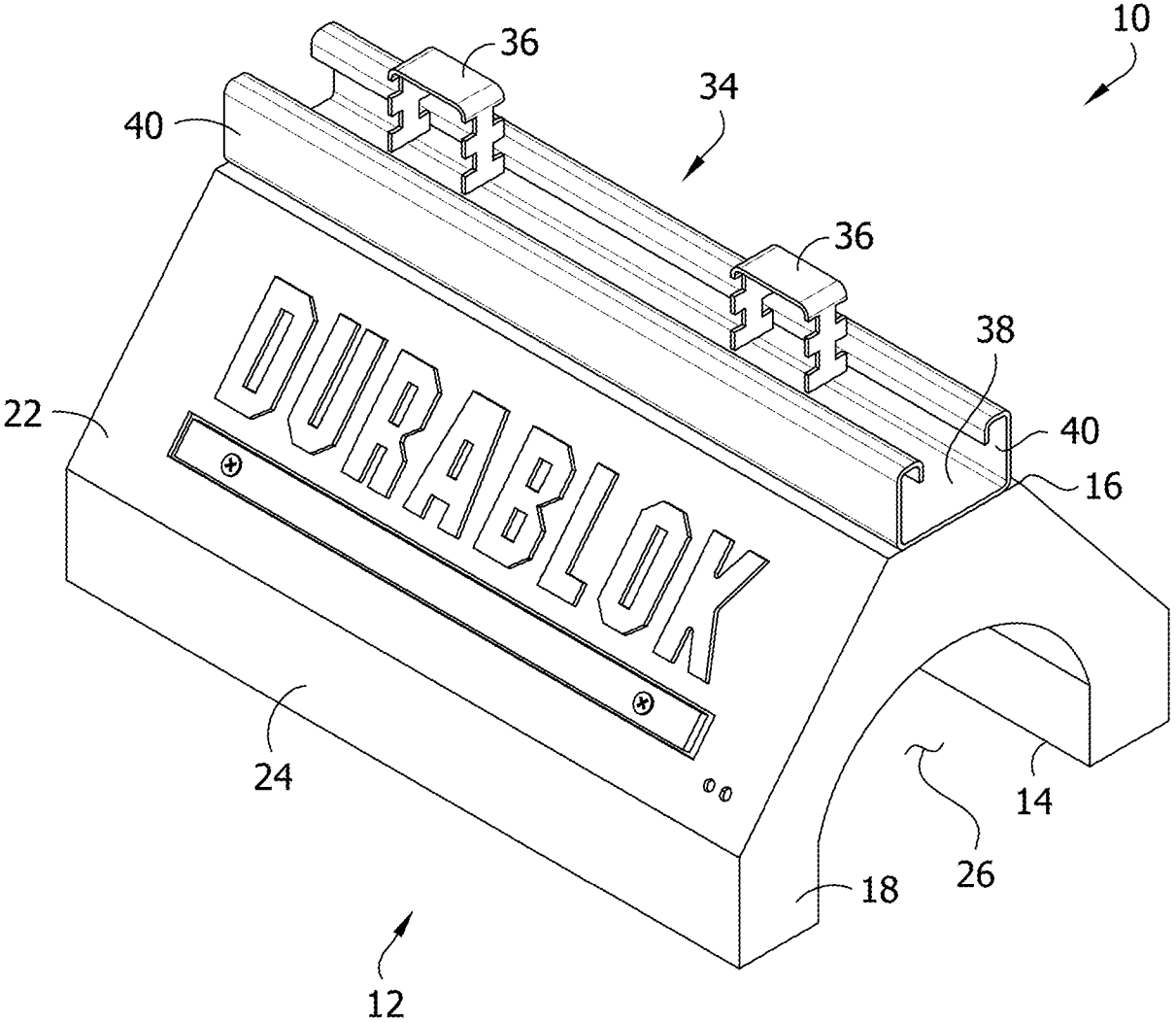
FIG. 2 is an exploded view of the support block assembly of FIG. 1, showing anchors with tangs.
Figure 3:
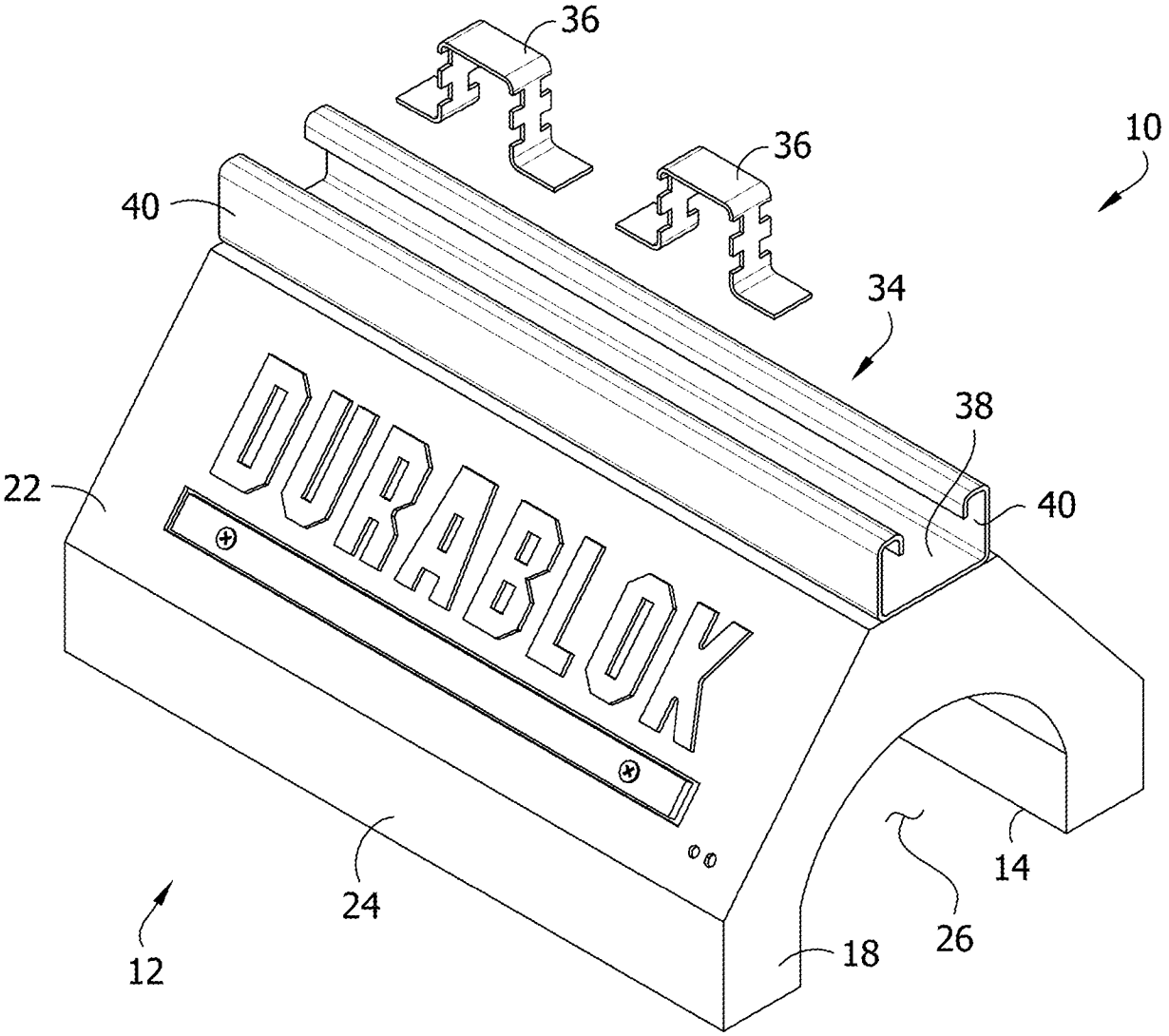
FIG. 3 is an exploded view of the support block assembly of FIG. 1, showing anchors with tangs and tongues.

Turning to FIGS. 1-6, a support block assembly, generally indicated at reference number 10, comprises at least one support block 12. The support block 12 can be molded, for example, from recycled tires or rubber material. The support block 12 generally has a bottom wall 14, a top wall 16, and two end walls 18 extending between (e.g., perpendicular to) the bottom wall 14 and the top wall 16. The top wall 16 has a width w1 less than the width w2 of the bottom wall 14. The support block 12 also has two side walls 22 extending longitudinally between the end walls 18. The side walls 22 slope downwardly and outwardly from the top wall 16 (having the narrower width w1) to the bottom wall 14 (having the wider width w2). In various aspects, the bottom portions 24 of the side walls 22 are not sloped and are generally perpendicular to the top wall 16 and the bottom wall 14. The bottom wall 14 may include cavities 26 that allow a majority of the interior volume of the support block 12 to be hollow. A divider wall 30 can extend between the side walls 22 and the top 16 and bottom walls 14 to block off adjacent hollow cavities 26 and to provide additional support to the support block 12.

The support block assembly 10 further includes a strut 34 secured, as described in greater detail below, to the top wall 16 of the support block 12. Generally, the strut 34 is secured to the top wall 16 of the support block 12 by at least one anchor 36 (e.g., two anchors). The strut 34 can be made of any suitable material, for example, metal (e.g., galvanized steel). The strut 34 can have a generally U-shaped cross section having a base 38, which is directly adjacent the top wall 16 of the support block 12, and two upright and opposing flanges 40 on either side of the base 38.

Figure 4A:
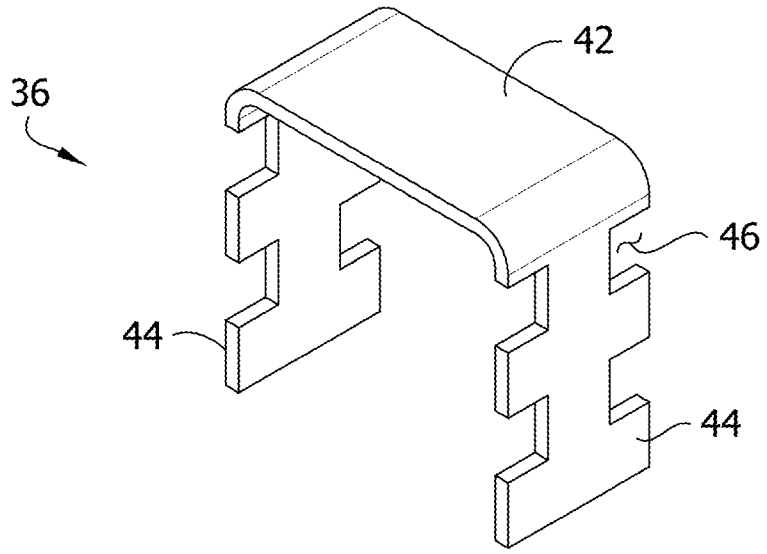
FIG. 4A is an enlarged perspective view of one of the anchors shown in FIG. 2.
Figure 4B:
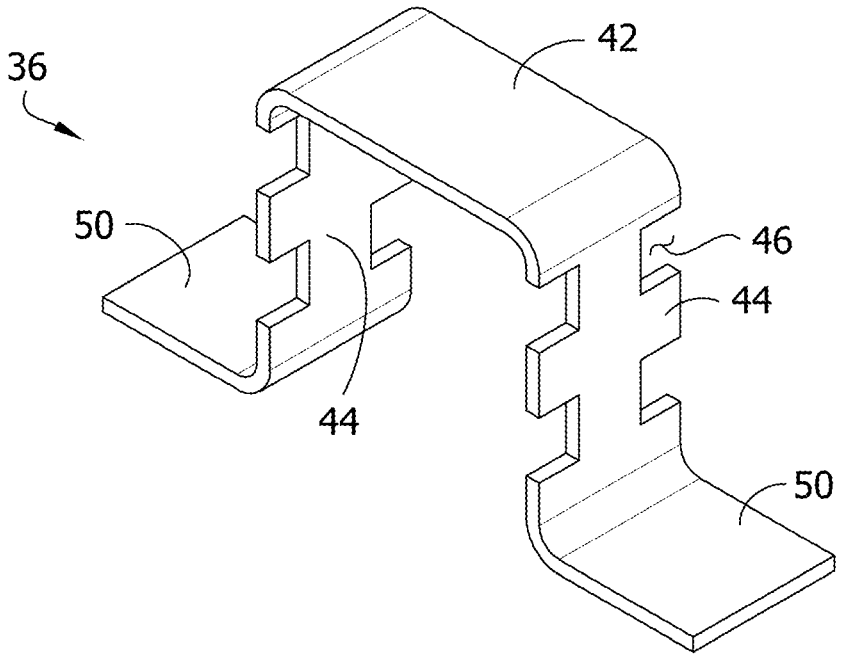
FIG. 4B is an enlarged perspective view of one of the anchors shown in FIG. 3.
Figure 5A:
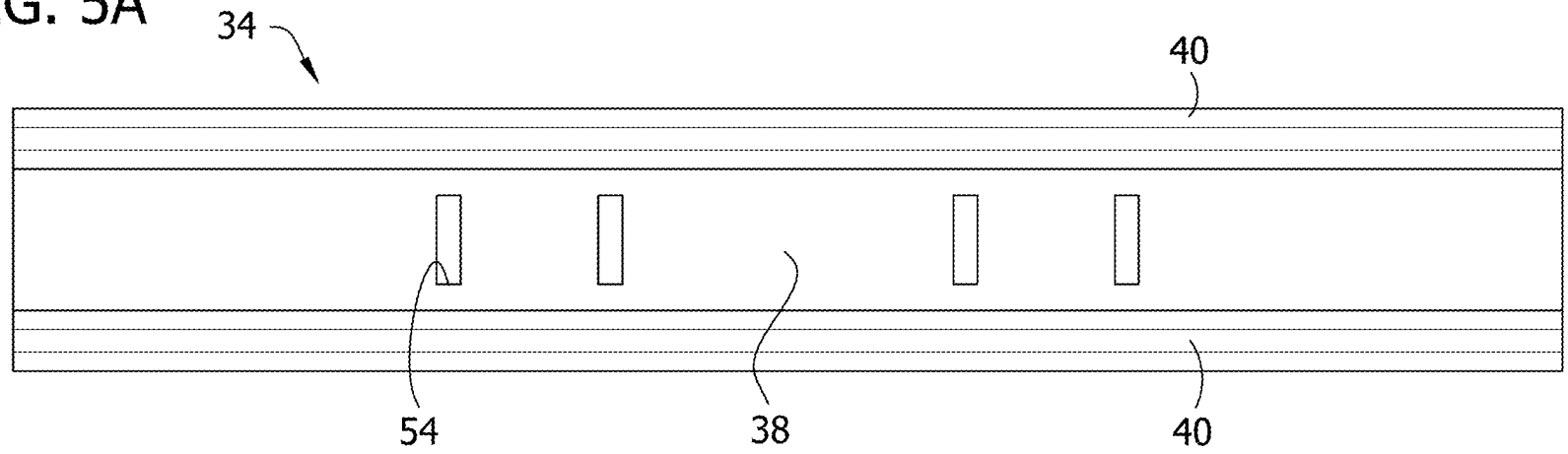
FIG. 5A is a top plan view of a strut used in the support block assembly of FIG. 1.
Figure 5B:
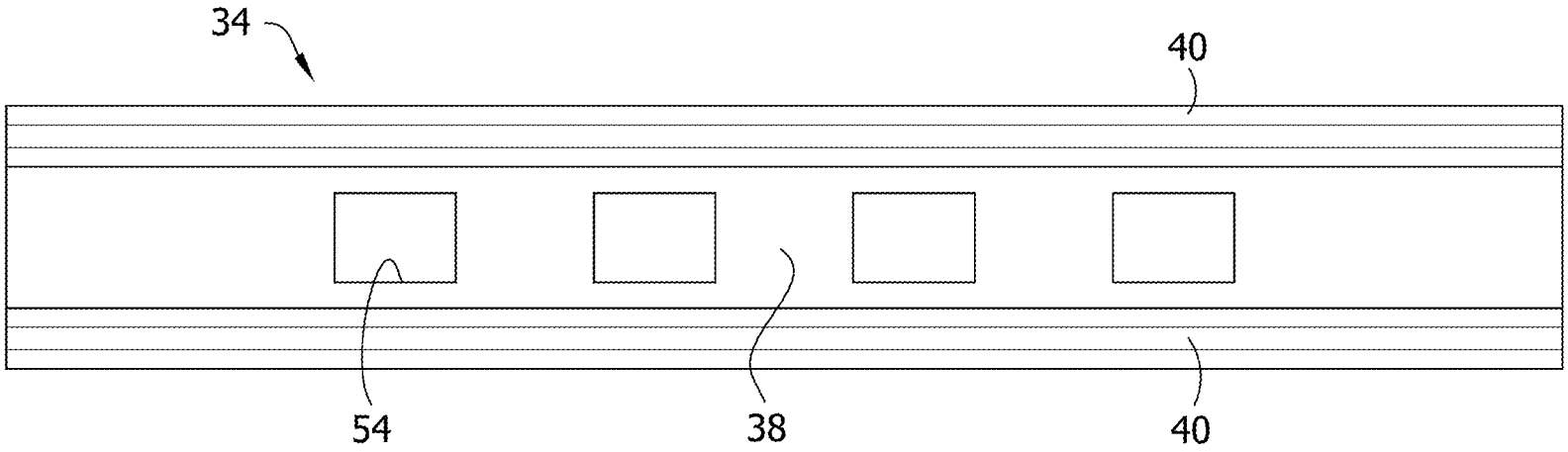
FIG. 5B is a top plan view of another type of strut used in the support block assembly of FIG. 1.
Figure 6:
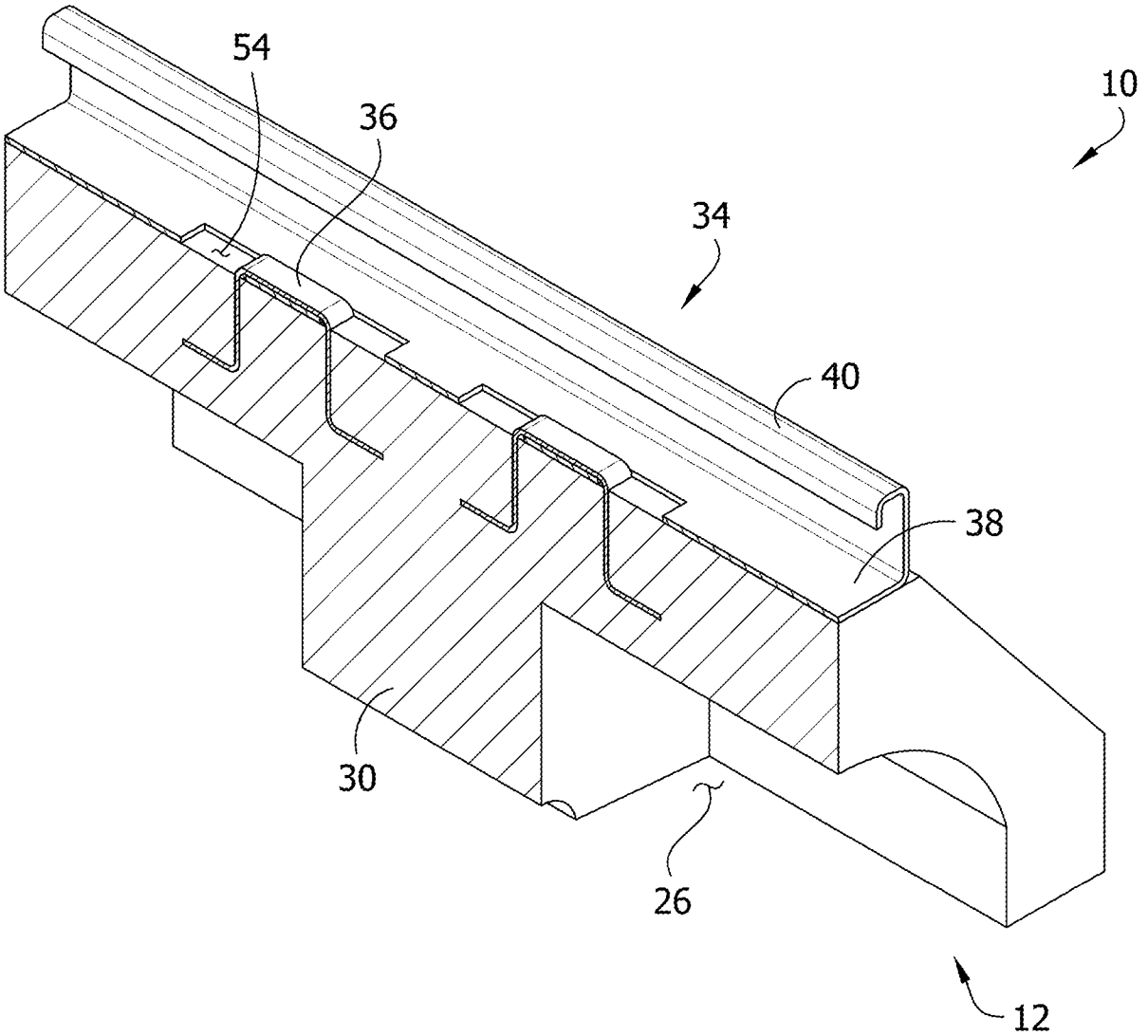
FIG. 6 is a perspective cross-sectional view of the support block assembly of FIG. 1.

As illustrated in FIGS. 4A and 4B, two anchors 36 are overmolded with the support block 12. As such, the anchors 36 are inserts on which the support block 12 is molded to form a mechanical and/or a chemical bond between the anchors and the support block. Each anchor 36 comprises a crown 42 and tangs 44 extending downward from respective opposite ends of the crown 42. The tangs 44 are received in the support block 12 by virtue of the block being overmolded around the tangs. Each tang 44 comprises recesses 46 (e.g., cutouts) to facilitate mechanical attachment of the anchor 36 to the block 12. In various aspects and as illustrated in FIG. 4B, a tongue 50 extends laterally outward from (e.g., generally perpendicular to) each tang 44 at a lower end thereof. The tongues 50, like the tangs 44, are received in the support block 12 by virtue of the block being overmolded around the flanges. The flanges 50 further facilitate mechanical attachment of the anchor 36 to the support block 12. Alternatively, as illustrated in FIG. 4A, the bottom of the tang 44 may not include a tongue.

The strut 34 defines openings 54 in the base 38 thereof through which the tangs 44 of the anchor 36 extend. For example, when two anchors 36 are used, the base 38 of the strut 34 may define four openings 54. Where the anchors 36 include tongues 50, the openings 54 in the base 38 of the strut 34 may be larger to allow for clearance of the tongues 50 (see FIG. 5B). Alternatively, where the anchors 36 do not include tongues 50, the openings 54 in the base 38 of the strut 34 may be narrower (smaller) (see FIG. 5A). With the tangs 44 (and tongues 50) inserted through the respective openings 54 in the base 38 of the strut 34 and being encased with the support block 12, the tangs extend through the top wall 16 of the block and the crown 42 engages the base 38 of the strut to couple the anchor to the strut and secure the strut to the top wall of the block.

In an exemplary method of making the support assembly 10, the tangs 44 (and tongues 50) of the anchors 36 are inserted into the respective openings 54 in the base 38 of the strut 34. The support block 12 is then overmolded around the tangs 44 (and tongues 50) so that the tangs (and tongues) are encased within the support block to form a mechanical and/or chemical bond between the anchors 36 and the support block. As assembled, the crowns 42 engage the base 38 of the strut to hold and attach the strut on the top wall 16 of the block.

Figure 7:
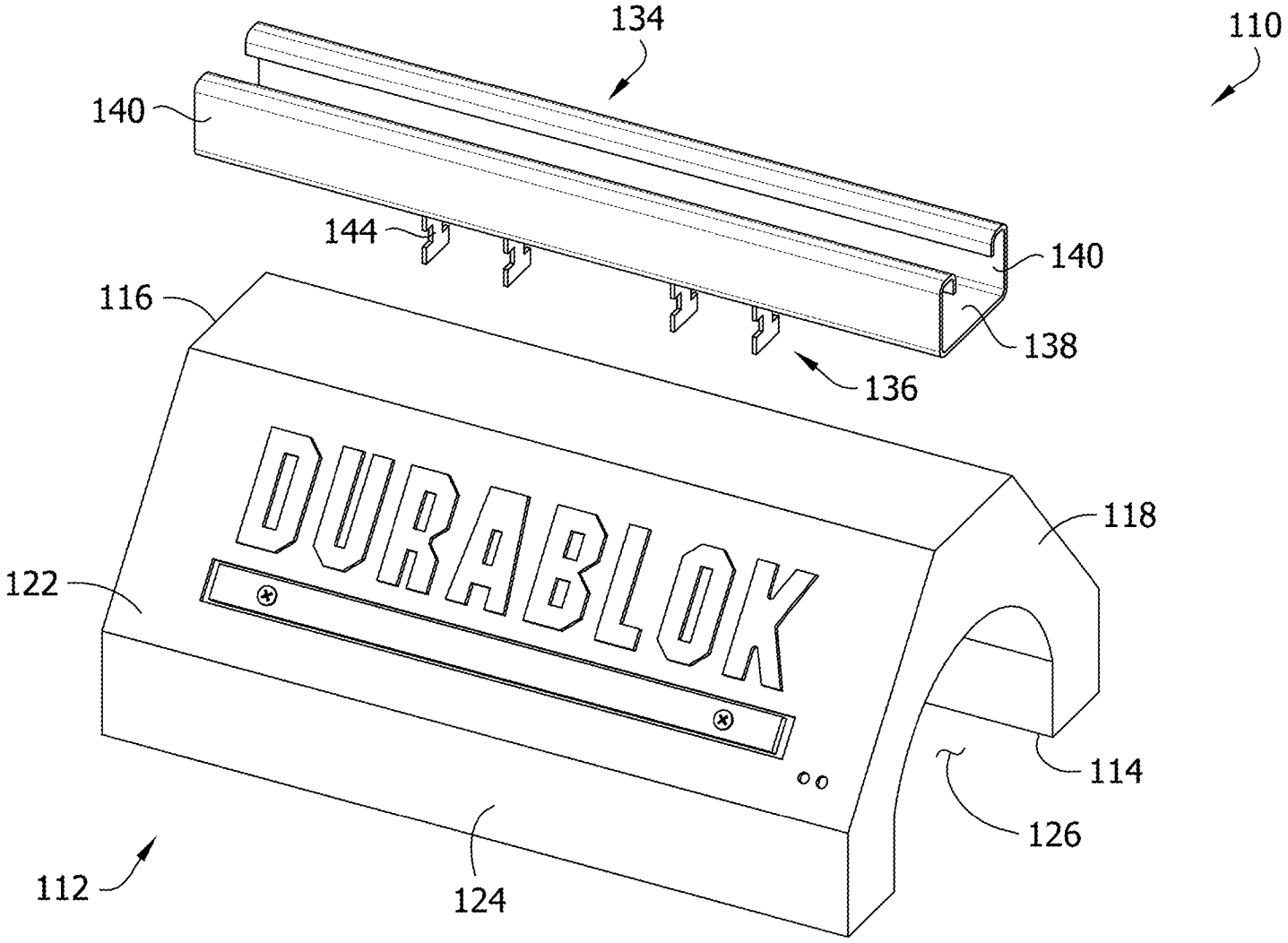
FIG. 7 is a perspective view of another embodiment of a support block assembly, having a support block and a strut with integrally formed anchors.
Figure 8:
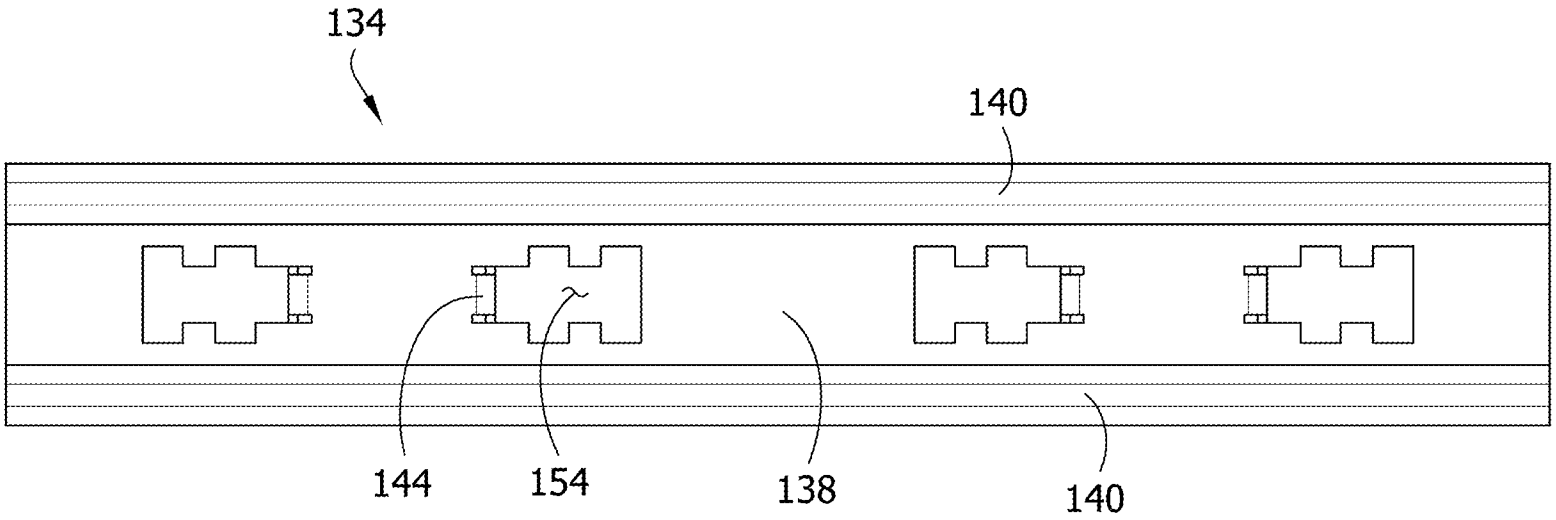
FIG. 8 is a top plan view of the strut shown in the support block assembly of FIG. 7.
Figure 9:
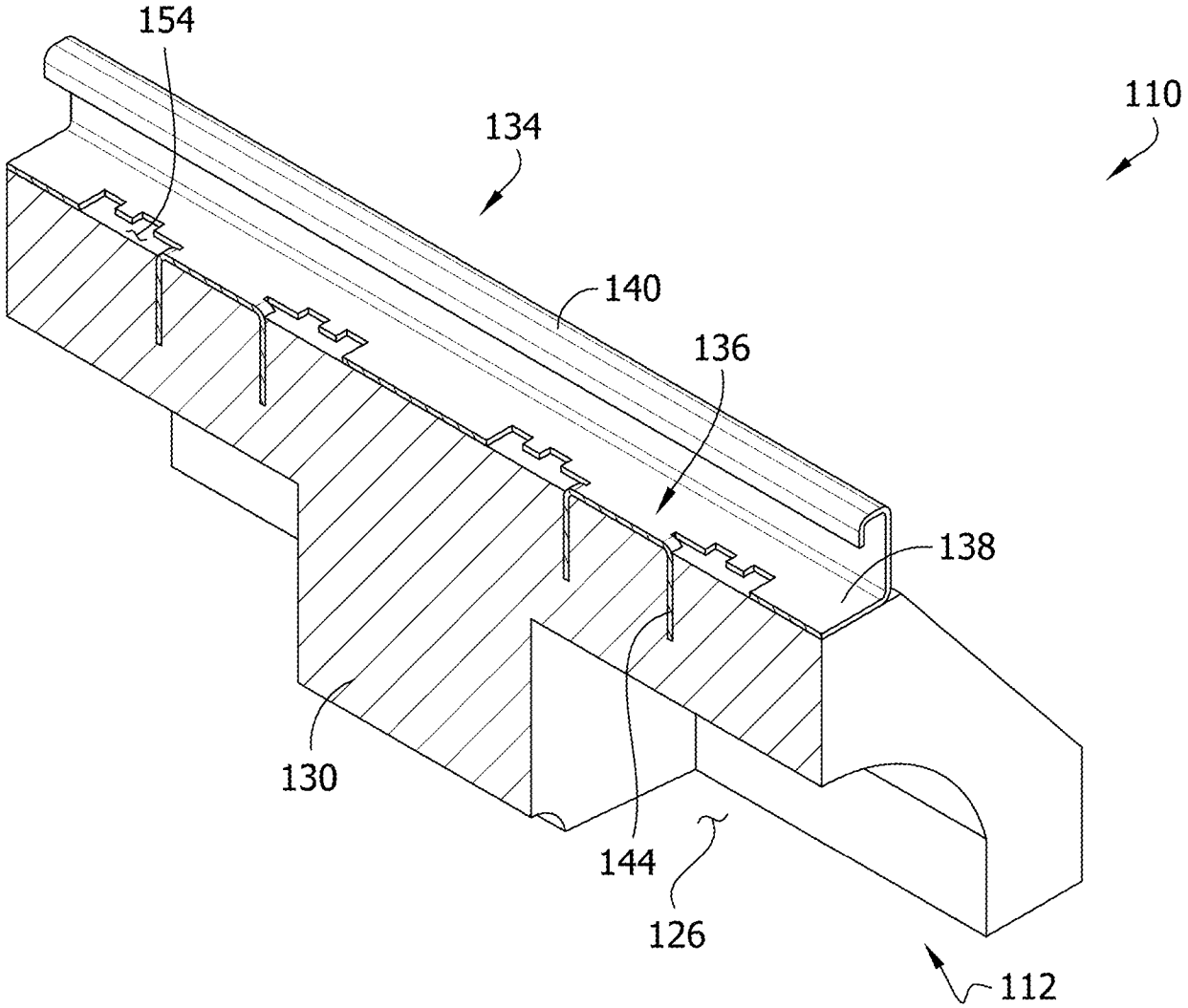
FIG. 9 is a perspective cross-sectional view of the support block assembly of FIG. 7.

Turning now to FIGS. 7-9, another embodiment of the support block assembly is generally indicated at reference numeral 110. The support block assembly 110 is similar to the support block assembly 10, and corresponding features are generally indicated by the same reference number plus 100.

The support block assembly 110 includes a strut 134 having integrated anchors 136. The anchors 136 generally include tangs 144 extending perpendicularly to the base 138 of the strut 134. The tangs 144 can be punched out of the base 138 of the strut 134, which causes the base 138 to define several openings 154 that generally correspond to the size and shape of the tangs 144. As with the previous embodiment, the support block 112 is overmolded around the tangs 144 so that the tangs 144 extend through the top wall of the block and are encased in the support block to form a mechanical and/or chemical bond between the tangs and the support block and secure the strut to the top wall of the block.

Figure 10:
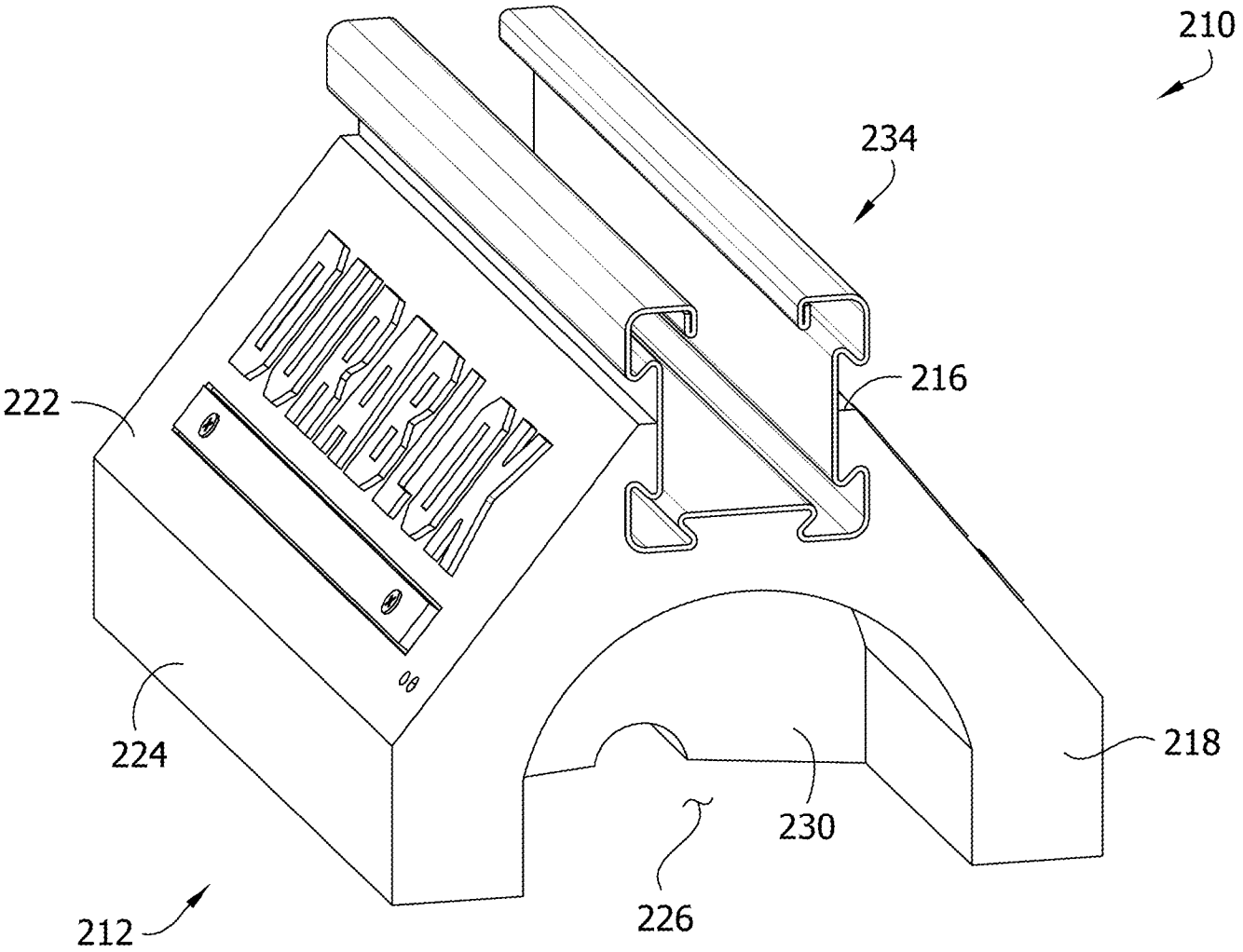
FIG. 10 is a perspective view of another embodiment of a support block assembly, having a support block overmolded around a strut.
Figure 11:
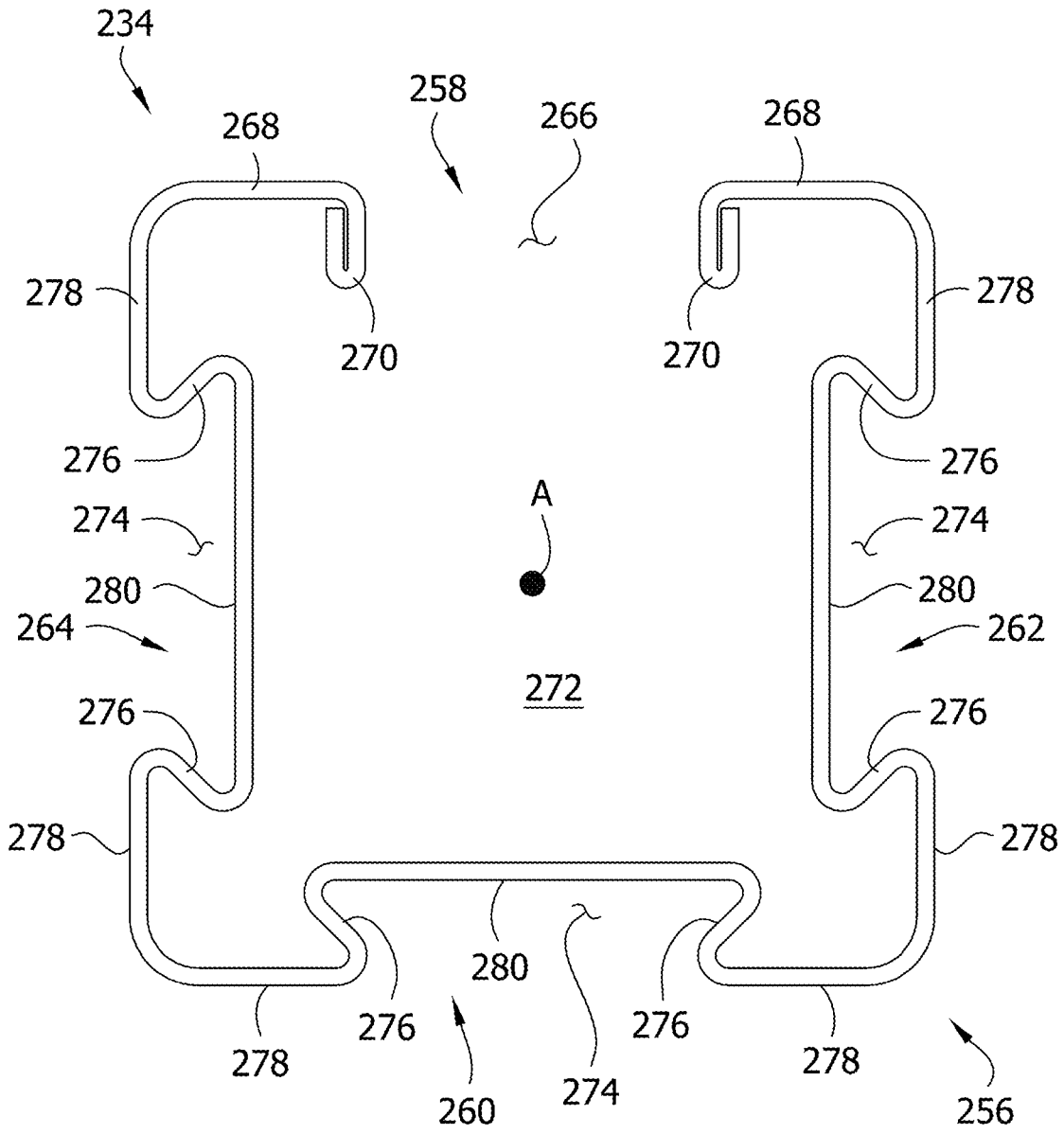
FIG. 11 is a side elevational view of the strut used in the support block assembly of FIG. 10.

Turning now to FIGS. 10 and 11, another embodiment of the support block assembly is generally indicated at reference numeral 210. The support block assembly 210 is similar to the support block assembly 10, and corresponding features are generally indicated by the same reference number plus 200. The strut 234 of the support block assembly 210 generally comprises an elongate body 256 having a longitudinal axis A and defining an interior extending along the length of the body 256. The body has an upper side 258, a lower side 260, a right side 262, and a left side 264, although the respective relative locations of the respective sides will depend on the orientation during use. The upper side 258 (or slotted side) defines a continuous slot 266 (i.e., the upper side is open). The upper side 258 has outer surfaces 268 on either side of the slot 266, and inwardly (or downwardly) extending lips 270 leading to an open interior 272 of the strut 234.

Each of the lower, right and left sides 260, 262, 264, respectively, defines a fitting groove 274 having a length, extending lengthwise of the body 256, and a depth extending generally toward the longitudinal axis A of the body 256. In the illustrated embodiment, the fitting groves 274 have substantially identical cross-sectional shapes and dimensions. Each fitting groove 274 is defined by opposing side walls 276 extending inwardly from generally planar outer surfaces 278 of the corresponding side and toward the interior of the body 256. The side walls 276 extend to a bottom wall 280 that spans between and interconnects the side walls 276. The side walls 276 flare away from one another as they extend inward from the outer surfaces 278 toward the bottom of the fitting groove 274, so that each fitting groove 274 has a generally dove-tail cross-sectional shape.

In general, the support block 212 is overmolded on the strut 234, such that the support block 212 is molded around the lower side 260 and partially up to the right and left sides 262, 264. In this way, the support block 212 is received in the bottom, left, and right fitting grooves 274. The bottom fitting groove 274 is filled with the support block material, and the left and right fitting grooves are partially filled with the support block material. The overmolding of the support block 212 on the strut 234 forms a mechanical and/or chemical bond between the strut and the support block.

Figure 12:
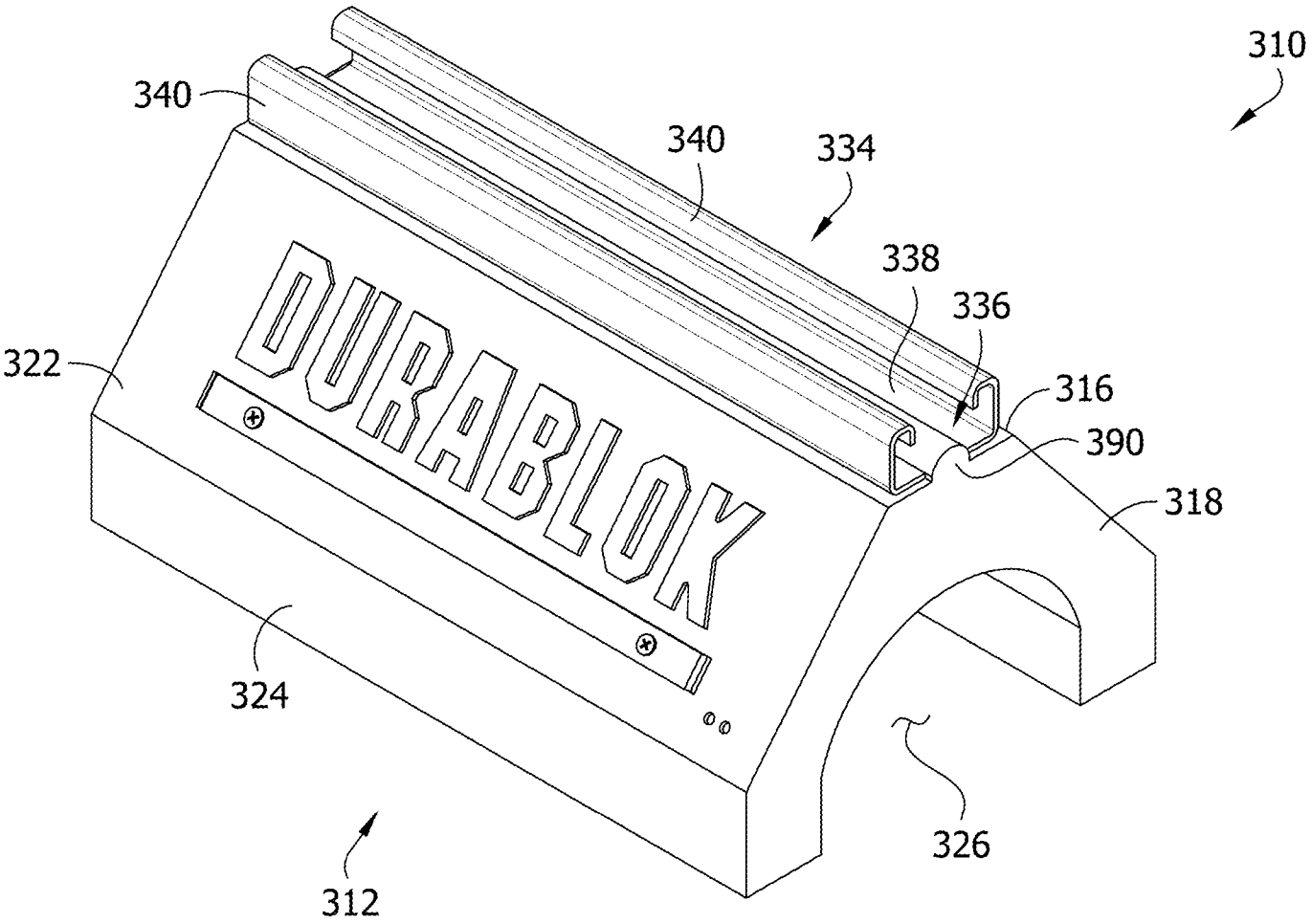
FIG. 12 is a perspective view of another embodiment of a support block assembly, having a support block overmolded on a strut.
Figure 13:
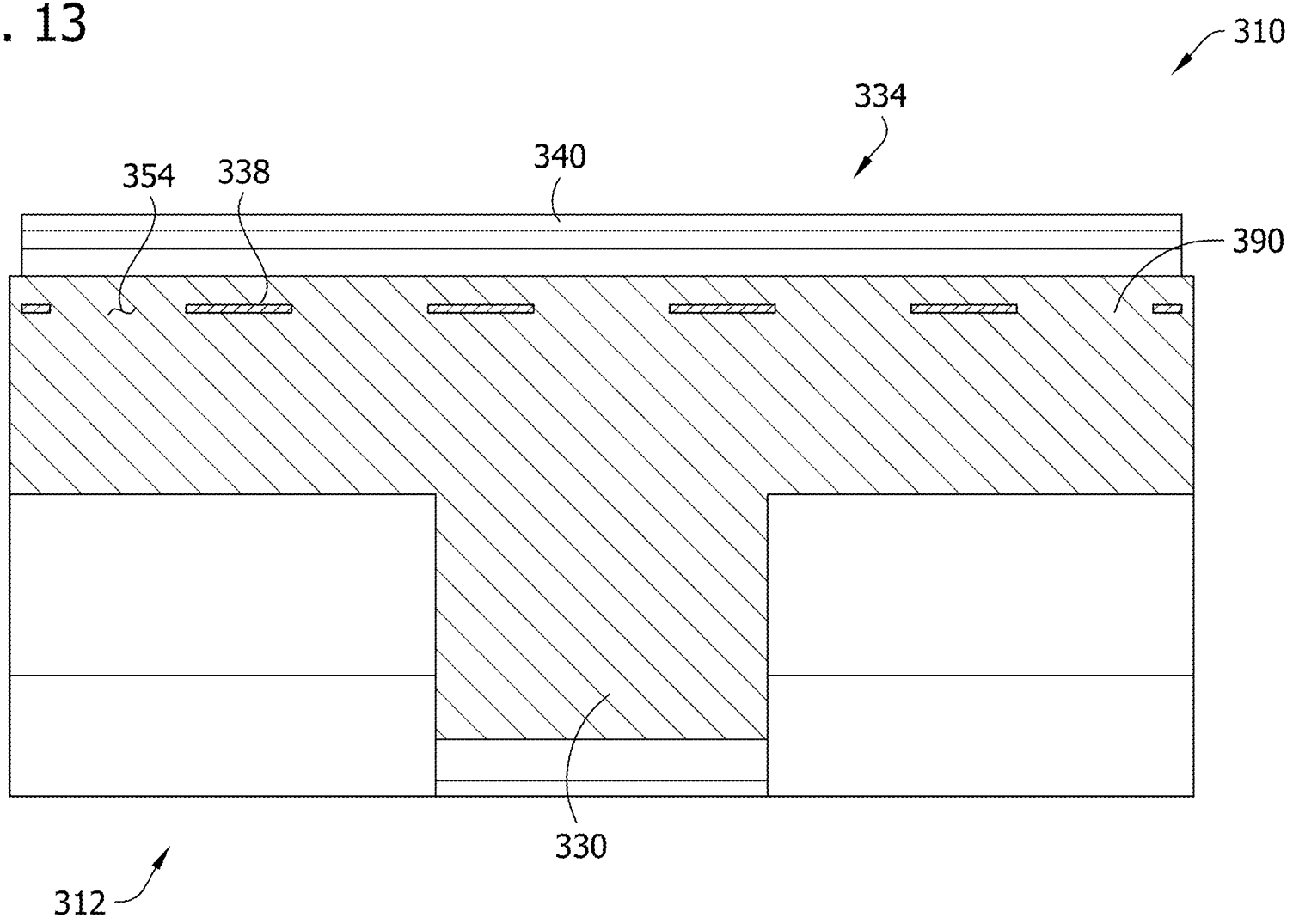
FIG. 13 is a cross-sectional view of the support block assembly of FIG. 12.
Figure 14:
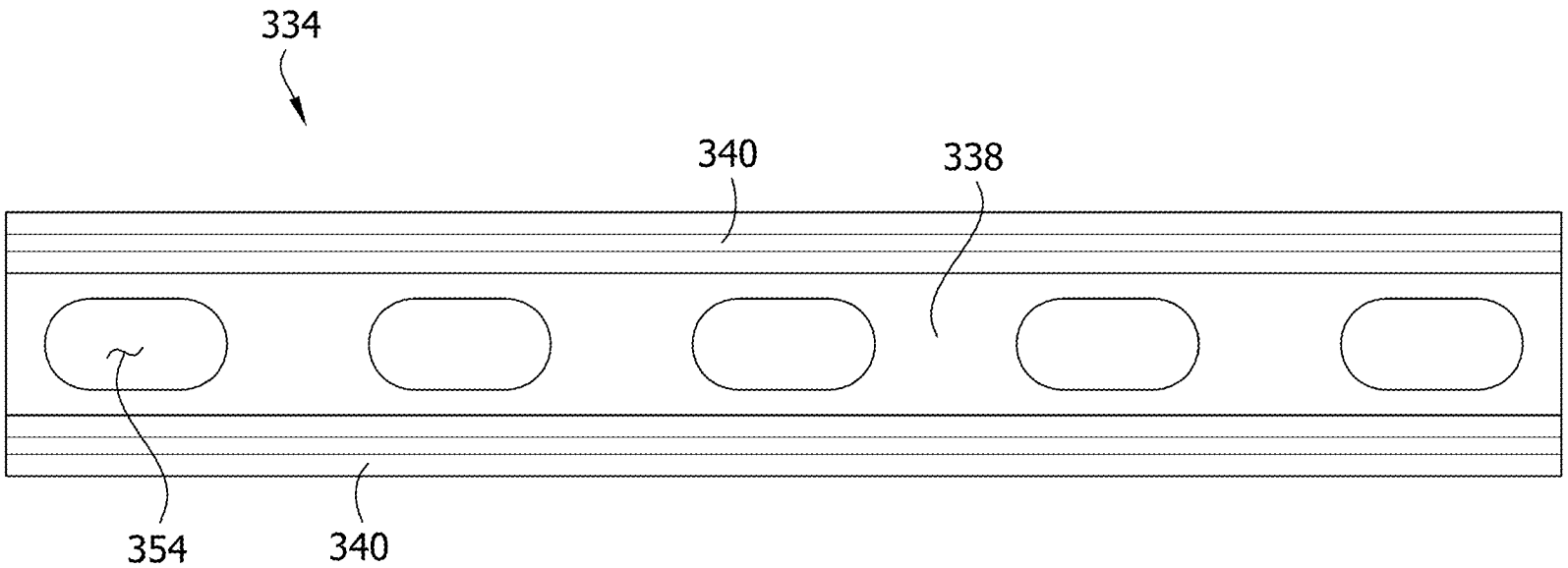
FIG. 14 is a top plan view of a strut used in the support block assembly of FIG. 12.

Turning now to FIGS. 12-14, another embodiment of the support block assembly is generally indicated at reference numeral 310. The support block assembly 310 is similar to the support block assembly 10, and corresponding features are generally indicated by the same reference number plus 300. The support block 310 is overmolded on the strut 334. The base 338 of the strut 334 defines several openings 354, through which the material of the support block (e.g., rubber) extends once the overmolding process is complete. In this way, at least longitudinal portions of the base extending between the openings 354 are encased within the support block, as shown in FIG. 13. In one example, a continuous rib 390 extends longitudinally over the center of the base 338 of the strut 334. In another example, the rib may be non-continuous, thus defining a plurality of spaced apart nibs extending through the openings 354 in the base 338.

Having described the invention in detail, it will be apparent that modifications and variations are possible without departing from the scope of the invention defined in the appended claims.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

The invention claimed is:

1. A support block assembly comprising:

a strut including a base;

an anchor coupled to the strut and including a tang extending downward from the base of the strut; and a support block having a top wall and being overmolded on the tang of the anchor such that the strut extends above the top wall and the tang extends into the support block and is encased within the support block to form a mechanical and/or chemical bond between the tang and the support block to secure the strut to the support block.

2. The support block assembly of claim 1, wherein the anchor further includes a crown having opposite first and second ends, wherein the tang includes first and second tangs extending downward from the respective first and second ends of the crown.

3. The support block assembly of claim 2, wherein the base of the strut defines a pair of spaced apart openings, wherein the first and second tangs extend through the respective first and second openings and the crown extends between the pair of openings.

4. The support block assembly of claim 3, wherein the anchor further comprises two tongues, one of the tongues extending laterally outward from the first tang and the other of the tongues extending laterally outward from the second tang.

5. The support block assembly of claim 1, wherein the base of the strut defines an opening through which the tang extends.

6. The support block assembly of claim 1, wherein the tang of the anchor is punched out of and bent downward from the base of the strut.

7. The support block assembly of claim 1, wherein the support block includes a top wall, wherein the tang extends through the top wall of the support block to secure the strut to the top wall of the support block.

* * * * *